United States Patent [19]

Tsudaka et al.

[11] Patent Number: 4,511,241

[45] Date of Patent: Apr. 16, 1985

[54] COPYING APPARATUS

[75] Inventors: Hideaki Tsudaka; Takaji Washio; Nobuhiko Kozuka; Masahide Iseki; Toshio Watanabe; Masami Kai; Toshio Yoshiyama; Hiromi Sakata, all of Osaka, Japan

[73] Assignee: Mita Industrial Company Limited, Osaka, Japan

[21] Appl. No.: 400,284

[22] Filed: Jul. 21, 1982

[30] Foreign Application Priority Data

Jul. 21, 1981 [JP] Japan ..... 56-114941
Jul. 21, 1981 [JP] Japan ..... 56-114942
Nov. 27, 1981 [JP] Japan ..... 56-191275

[51] Int. Cl.[3] ..... G03G 15/00
[52] U.S. Cl. ..... 355/14 CU; 355/14 R
[58] Field of Search ..... 355/35 H, 14 SH, 14 R, 355/3 R, 14 CU; 235/61 PK, 61 PC, 61 PD, 61 PE

[56] References Cited

U.S. PATENT DOCUMENTS 3,588,472 6/1971 Galster et al. ..... 355/14 SH X

*Primary Examiner*—A. C. Prescott
*Attorney, Agent, or Firm*—Wenderoth, Lind & Ponack

[57] ABSTRACT

A copying apparatus capable of performing a first preset number of copying operations corresponding to a first original document in a successive copying operation mode, and performing a second preset number of copying operations corresponding to a second original document in an intruded copying operation mode includes preset number display elements for indicating a first and second preset numbers, first counter for counting a number of copying operations, a copy number display element for indicating a value counted by the first counting means, a second counter for counting a discharged copy paper after the completion of a copying operation, and a detector for detecting a jam of the copy paper. The counted value of the first counter is revised so as to be equal to the counted value of the second counter when a copy paper jam occurs.

16 Claims, 15 Drawing Figures

COPYING APPARATUS

BACKGROUND OF THE INVENTION

1. Field of the Invention

The present invention relates to a copying apparatus, and more particularly, to a copying apparatus which is capable of performing a successive copying operation mode wherein a first preset number of copying operations corresponding to a first original document is achieved successively and performing a intruded copying operation mode wherein a second preset number of copying operation corresponding to a second original document is intruded within the successive copying operation mode and then a remaining number of the first preset number corresponding to the first original document is achieved.

2. Description of the Prior Art

In a prior art arrangement, a number of copied sheets are counted when the sheets are fed from a cassette, and a desired preset number of copied sheets are obtained by ceasing feeding of copy paper sheets when the counted value reaches a preset number. Therefore, a significant problem is encountered in such a copying apparatus. When the copy paper is jammed in a copy sheet transporting path before completion of the preset number of copying operations in that copying mode and the jammed copy paper and any other copy paper located in the transporting path are taken out from a housing of the copying apparatus during a interruption of the copying operation, the copy papers taken out from the housing have been counted. Therefore, when the copying operation is commenced again, the number of copied sheets obtained is less than the preset number by the number of the copy papers which has been taken out from the housing. Consequently, in the prior art, it is necessary to revise the previously preset number of copying operations when the copying operation is commenced again after releasing a copy paper jam.

Accordingly, it is an object of the present invention to provide an improved copying apparatus which is capable of performing the successive copying operation without resetting the number of copying operations so as to obtain a desired number of copied sheets after a paper jam is released.

SUMMARY OF THE INVENTION

To accomplish the foregoing object, there is provided a copying apparatus which comprises a preset number display element for displaying a preset number of copying operations, a first counting means for counting copying operations each time that a single of copying operation is performed, a copy number display element for indicating a number counted by the first counting means, a second counting means for counting a copy paper discharged after completion of a copying operation, and the detecting means for detecting occurrence of copy paper jamming. When a copy paper is jammed, the value counted by the first counting means is revised so as to be equal to a value counted by the second counting means.

According to the present invention, the copying apparatus is capable of performing the successive copying operations without resetting the number of copying operations so as to obtain a desired number of copied sheets after a paper jam is released.

According to the preferred embodiment of the invention, a change of operation mode is prohibited when the copy paper sheet is jammed at the change of operation modes between the successive copying operation mode and the intruded copying operation mode. A revise key is also provided, and in response to a signal from the revise key, the control means causes the preset number display element to indicate the revised number of copying operations. Furthermore, the size display element corresponding to the size of the copy paper sheet kept in the cassette turns on and off repeatedly, and the size display element corresponding to the original document in the successive copying operation mode turns on when the size of the copy paper sheets kept in the cassette are not suitable for copying the original document in the successive copying operation mode after the operation mode returns to the successive copying operation mode from the intruded copying operation mode.

BRIEF DESCRIPTION OF THE DRAWINGS

A detailed description of the invention will be made with reference to the accompanying drawings, which are to scale. Like numelals designate corresponding parts in the several figures.

DETAILED DESCRIPTION OF THE PREFERRED EMBODIMENT

The following detailed description is of the best presently contemplated mode of carrying out the invention. This description is not to be taken in a limited sense, but is made merely for the purpose of illustrating the general principles of the invention since the scope of the invention is best defined by appended claims.

Figure 1:
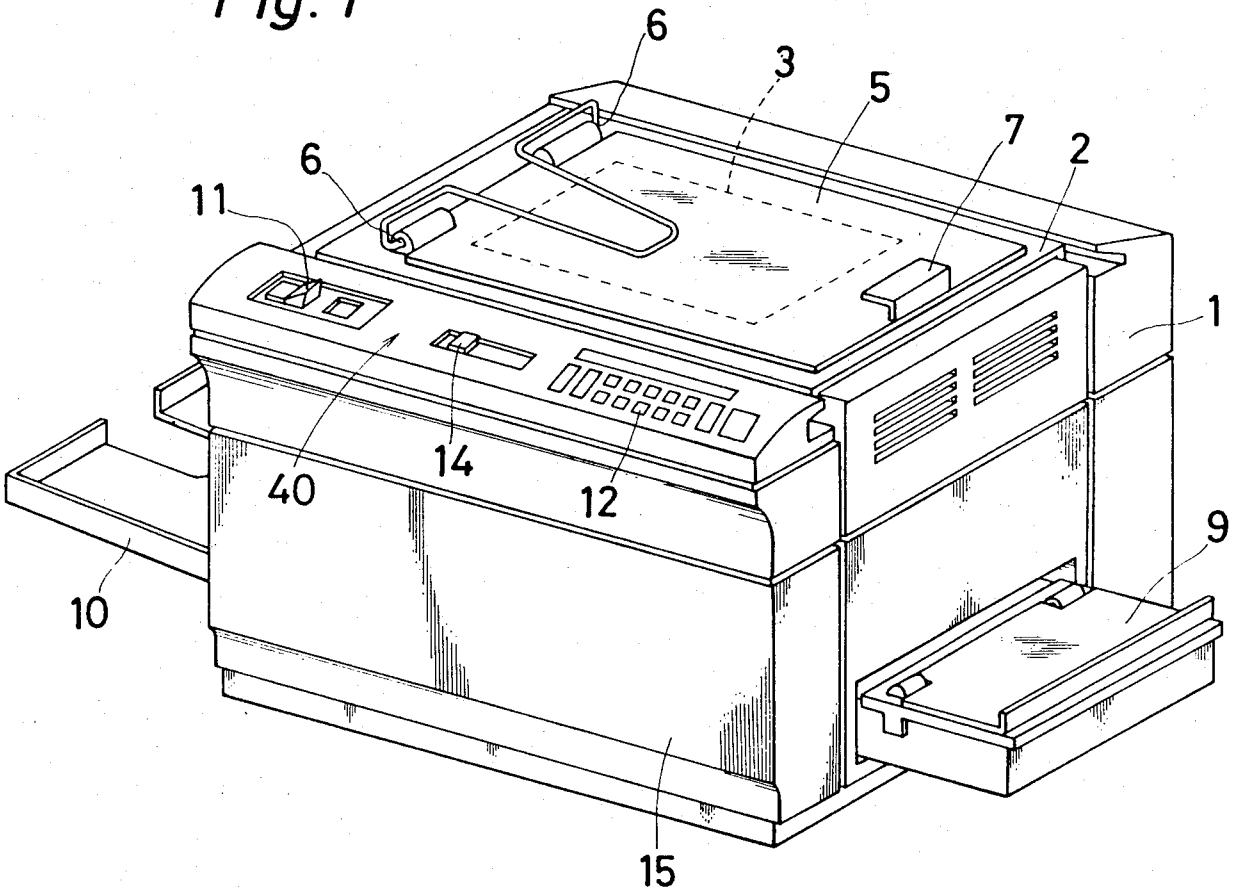
FIG. 1 is an overall perspective view of a copying apparatus according to an embodiment of the present invention.
Figure 2:
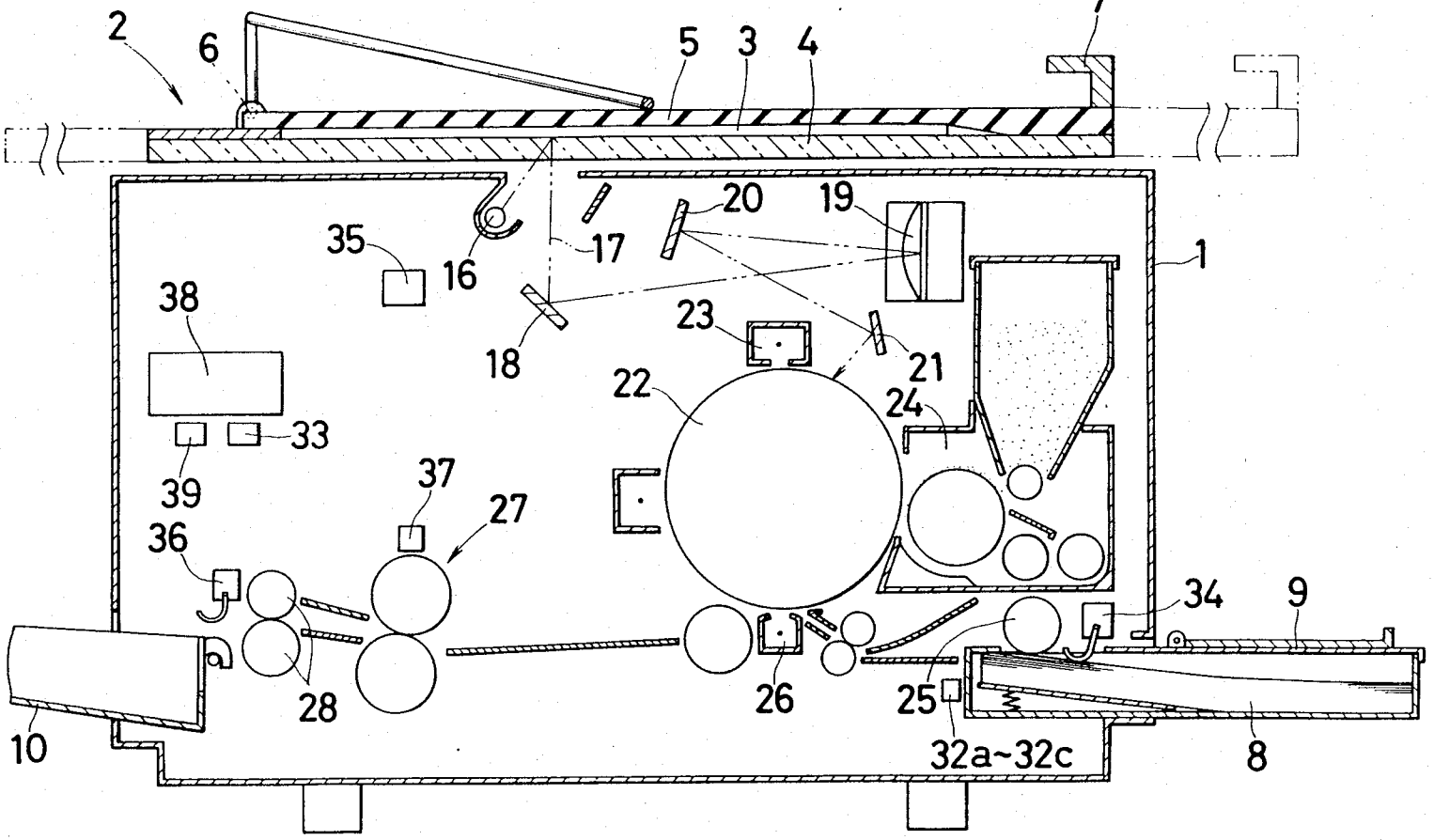
FIG. 2 is a simplified vertical sectional view of FIG. 1.

Referring now to FIG. 1 which is a perspective view illustrating a general construction of an embodiment according to the present invention and FIG. 2 which is a simplified schematic elevational view of the embodiment, there is provided an original document table 2 capable of moving horizontally in a lateral direction of FIG. 2 in the upper position of a housing 1 of an electrostatic copying apparatus. The original document table 2 has a transparent plate 4 on which a original document to be copied is placed. The original document 3 is covered by means of the original document-pressing cover 5 which is supported to be swingable around a rotary shaft 6 having an axis parallel to the transparent plate 4 on the original document table 2. The original document-pressing cover 5 is provided with a handle 7 for opening and closing the original document-pressing cover 5. The original document-pressing cover 5 is of a size which is larger than the maximum size of the original document to be copied. A cassette 9 is mounted on one side (right hand side in FIG. 2) of the housing 1 for storing sheets of copy papers 8 having sizes corresponding to the sizes of Japanese Industrial Standard A3, B4, A4, B5, A5 and B6. Completed copy sheets are fed out on a tray 10 mounted at the other side of the housing 1 (left side in FIG. 2.) The housing 1 is capable of being opened by pulling a front panel 15 over the paper of FIG. 2 when the copying apparatus is repaired.

In the housing 1, light from an exposure lamp 16 fixed under the transparent plate 4 passes through the transparent plate 4, is reflected by the original document 3, and then reaches an outer surface of a photosensitive drum 22 through a mirror 18, mirror lens 19 and mirrors 20 and 21 as shown by a dotted line 17 to form an image of the original document. Consequently, an electrostatic latent image of the original document 3 is formed on the photosensitive drum 22 which is charged by a charging device 23. The electrostatic latent image is developed as a toner image by a developing device 24. Copy papers 8 in the cassette 9 are fed one by one by means of a paper feeding roller 25. A charging device 26 for transfer the serves to transfer toner image on the photosensitive drum 22 onto the copy paper 8. The transferred copy paper is fixed by a thermal fixing device 27 and then discharged on the tray 10 by means of discharging rollers 28.

A detecting switch 34 is provided above the cassette 9 in the housing 1 for detecting whether or not copy papers 8 are stored in the cassette 9. Size detector **32*a* to 32*c* are also provided for detecting the JIS A3, B4, A4, B5, A5 or B6 size of the copy paper 8 stored in the cassette 9. A jam detecting circuit 33 mounted in the housing 1 has two microswitches (not shown) spaced from each other in a transporting direction on a copy paper transporting path where the copy paper 8 is transported in the copying operation set forth above, The jam detecting circuit 33 detects a paper jam in the case where a copy paper 8 is not detected by the microswitch downstream in the transporting direction within a predetermined time period after the detection of the copy paper 8 by the microswitch upstream in the transporting direction, and in the case where the microswitch downstream in the transporting direction keeps detecting the copy paper 8 over a predetermined time period. A detecting switch 35 is provided on the upper position of the housing for detecting reciprocal movement of the original document table 2. A detecting switch 36 provided in the vicinity of the discharging rollers 28 detects a trailing edge of the copy paper 8 when copy paper 8 is discharged by the discharging rollers 28 on the tray 10. A temperature detector 37 is provided in the vicinity of the thermal fixing device 27. The temperature detector 37 detects that the temperature of the thermal fixing device 27 reaches a temperature suitable for fixing after a power switch in an operation panel 40 (shown in FIG. 3) is closed. When a paper jam is detected by the jam detecting circuit 33, the copying operation stops owing to a control means 38 which will be mentioned hereinafter. A reset switch 39 is mounted in the housing 1** for releasing the above-mentioned disabled state of the copying operation.

Figure 3:
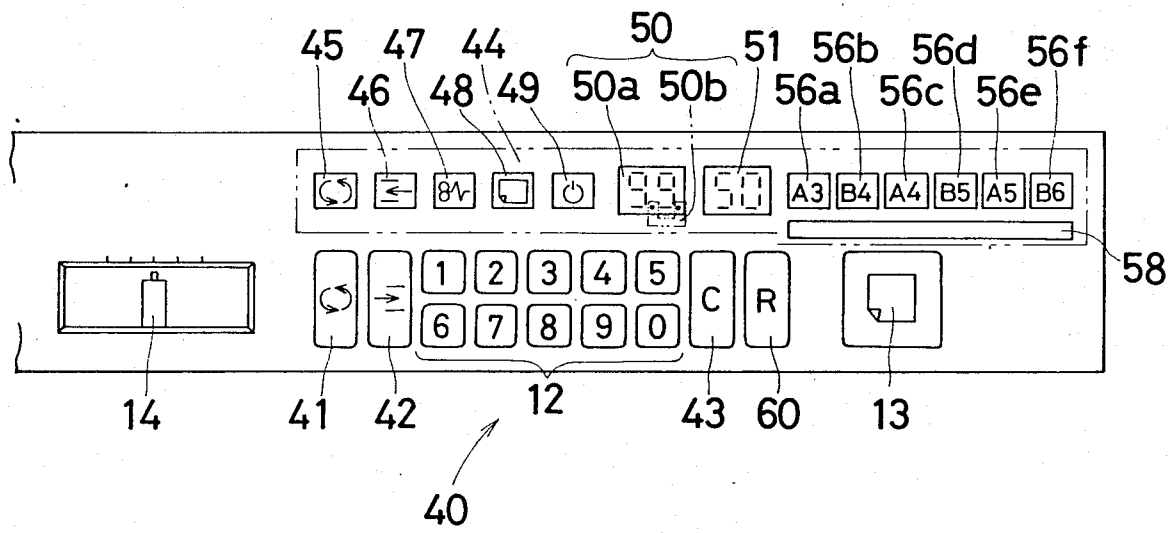
FIG. 3 is a plan view of an operation panel.

Referring further to FIG. 3, an operation panel 40 is provided on a front and top portion of the housing 1. The operation panel 40 comprises a power switch 11, a knob 14 for adjusting exposure density, a ten key 12, a print button 13, a memory key 41, an intrusion key 42, a clear key 43, a revise key 60 and display means 44 of a display device. The knob 14 is manually operated to adjust an image density of the toner image formed on the copy paper 8. The ten key 12 is manually operated to preset the number of copying operations and have numerals "0" to "9" on the faces thereof individually. The print button 13 is manually operated to commence the copying operation of the electrostatic copying apparatus. When the same number of copying operations are to be performed corresponding to each of original documents, the memory key 41 is manually operated to store the preset number until copying operations corresponding to the original documents are completed. During a plurality of copying operations corresponding to one original document, the intrusion key 42 is manually operated to store the remaining number of copying operations so that a copying operation corresponding to another original document is interposed so as to be performed. The clear key 43 is manually operated to clear the number which is preset by the ten key 12. The revise key 60 is manually operated to revise the preset number of copying operations before a plurality of preset number of coying operations corresponding to a single of the original document are completed.

The display means 44 comprises a plurality of display elements 45 to 49, **56*a* to 56*f*, and 58 for indicating symbols and abbreviations on the faces thereof, a preset number display element 50 having display segments driven to indicate a preset number, and a copy number display element 51 for indicating the number of copying operations which have been performed. The display element 45 is actuated at the same time that the memory key 41 is manually operated. The display element 45 indicates that the memory key 41 was manually operated. The display element 46 is actuated at the same that the intrusion key 42 is manually operated, and indicates manual operation of the intrusion key 42. The memory key 41 and the intrusion key 42 are manually operated successively to release the operation modes corresponding to the memory key 41 and the intrusion key 42. The display element 47 is actuated when the detecting circuit 33 detects the copy paper jamming and indicates the of jamming of the electrostatic copying apparatus. The display element 48 is actuated when the detecting switch 34 detects that copy papers 8 have been consumed in the cassette 9. The indicating element 49 is actuated just after the power switch 11 is turned on, and is turned off to indicate that the electrostatic copying apparatus is capable of performing a copying operation when the temperature detector 37 detects that the temperature of the heat fixing device 27 reaches a value suitable for heat fixing. The size display elements 56*a* to 56*f* are actuated in response to each of output signals from the size detectors 32*a* to 32*c*, and indicates which of JIS sizes A3, B4, A4, B5, A5 or B6 of the copy papers 8 are kept in the cassette 9. The display element 58 is actuated when the cassette keeping the sheets of copy papers having a size corresponding to the original document to be copied successively is not mounted on the housing 1 after the completion of the interposition of copying operation by means of the intrusion key 42, and notifies in a fashion such as "cassette size is unsuitable," to mean that the cassette suitable for the original document to be copied should be mounted on the housing 1. The preset number display element 50 is actuated by the manual operation of the ten key 12 to indicate the preset number of copying operation to be performed by means such as two figures. The preset number display element 50 comprises a display portion 50***a* composed of segments of 7B front and a display portion 50*b* for indicating dots. The copy number display element 51 indicates the accumulated number of copying operations actually performed in the electrostatic copying apparatus by means of, for example, two figures.

Figure 4:
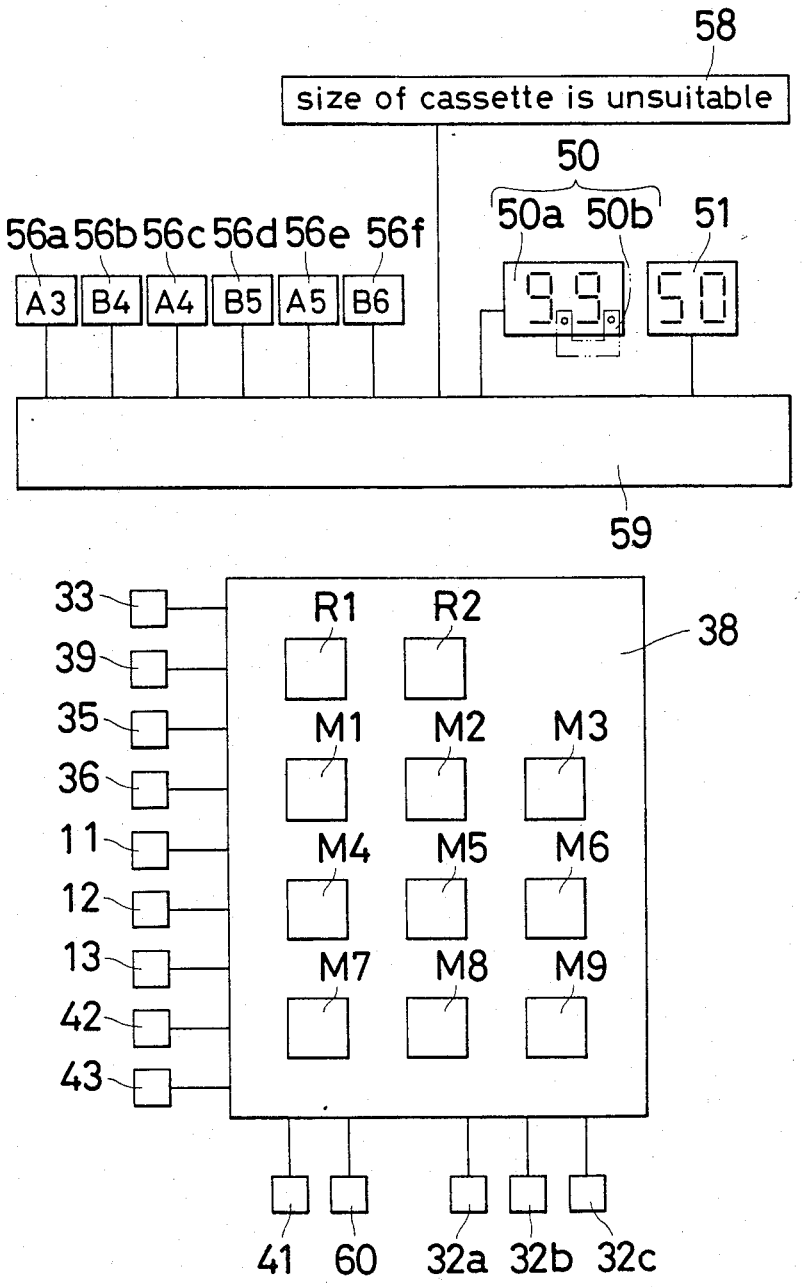
FIG. 4 is a simplified block diagram of a control system.

FIG. 4 is a simplified block diagram of a control system. A control means 38 receives signals from the jam detecting circuit 33, detecting switches 35 and 36, the reset switch 39, the power switch 11, the ten key 12, the print button 13, the memory key 41, the intrusion key 42, the clear key 43 and the revise key 60 to actuate the display elements 45 to 51, 56*a* to 56*f* and 58 of the display means 44. The control means 38 has a first register R1, second register R2 and first to ninth memories M1 to M9 which are associated with signals from the jam detecting circuit 33, the switches 35, 36, 39 and 11, the keys 12, 41, 42, 43, and 60, and the print button 13. Each time that registers R1 or R2 receive a high level pulse signal at an input terminal (not shown), that register serves to add pulse number of the signals to a prestored number, that is, to count the number of pulse signals, and to store the resultant value. Each register R1 and R2 receives a signal indicating a number from the memories M1 to M9 as set forth hereinafter and stores the number. In each register R1 and R2, a prestored number is erased when the signal indicating a number from the memories M1 to M9 is supplied, and the number supplied from the memories M1 to M9 is stored. The control means 38 is responsive to signals from the jam detecting circuit 33, the switches 35, 36, 39 and 11, the keys 12, 41, 42, 43 and 60, and the print button 13, and drive the preset number display element 50, the copy number display element 51, the display elements 56*a* to 56*f* and a display element 58 via the driving means 59.

Figure 5:
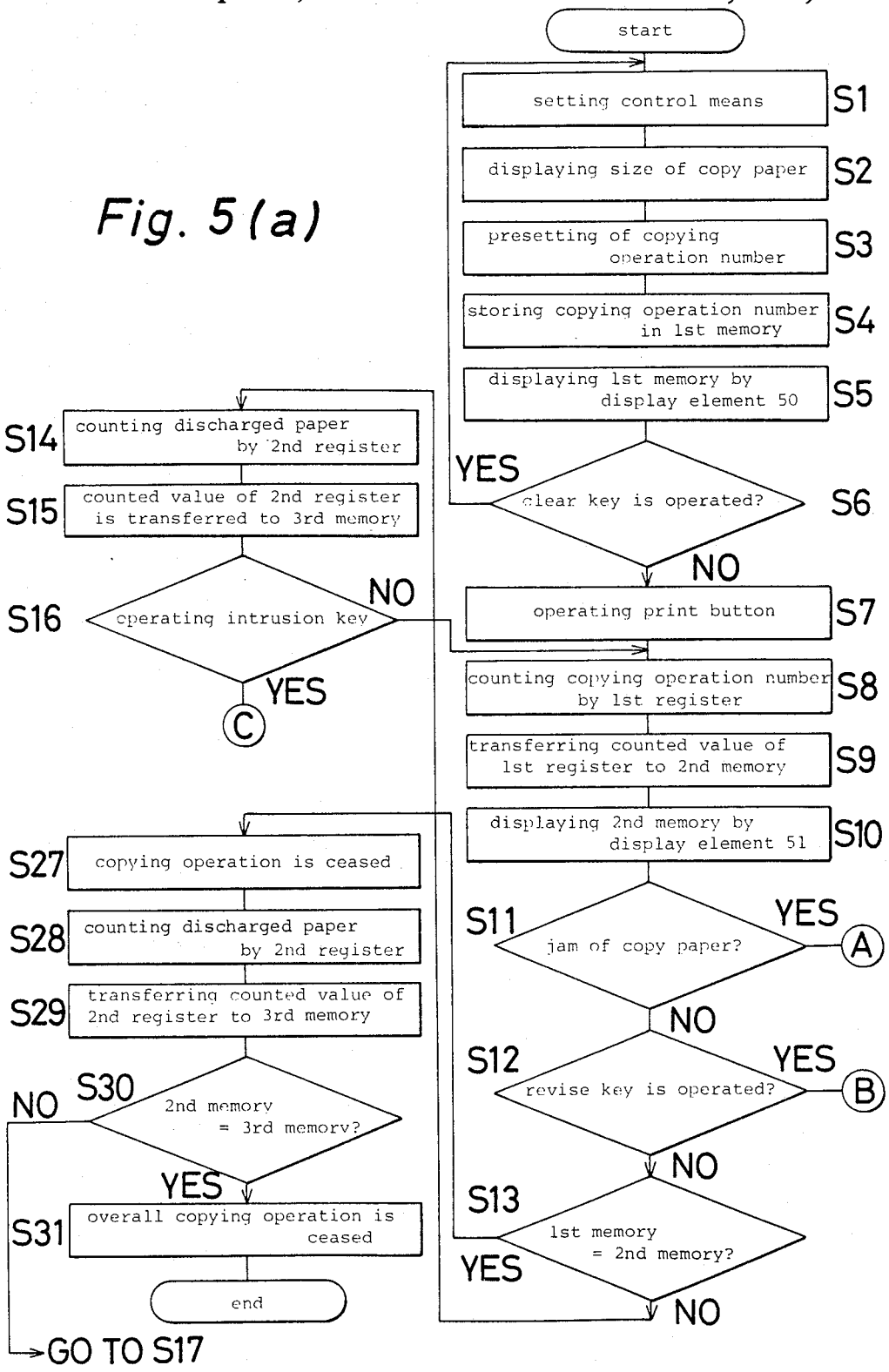
FIGS. 5 (*a*), (*b*) and (*c*) are flow charts illustrating a operation of the control system in a successive copying operation mode.
Figure 5B:
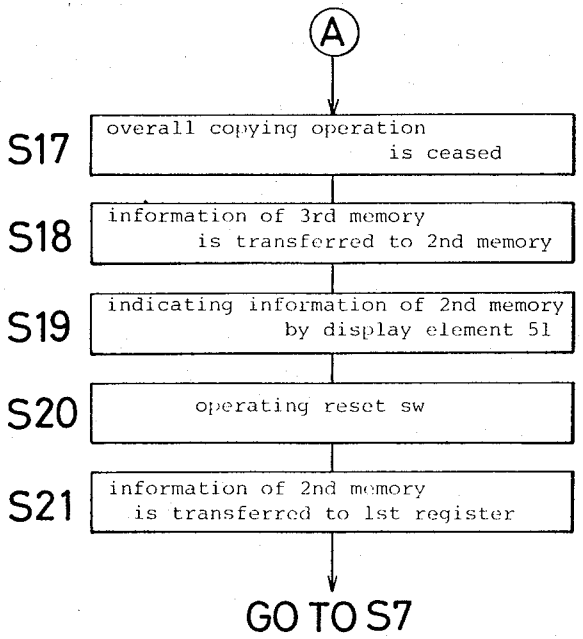
Figure 5C:
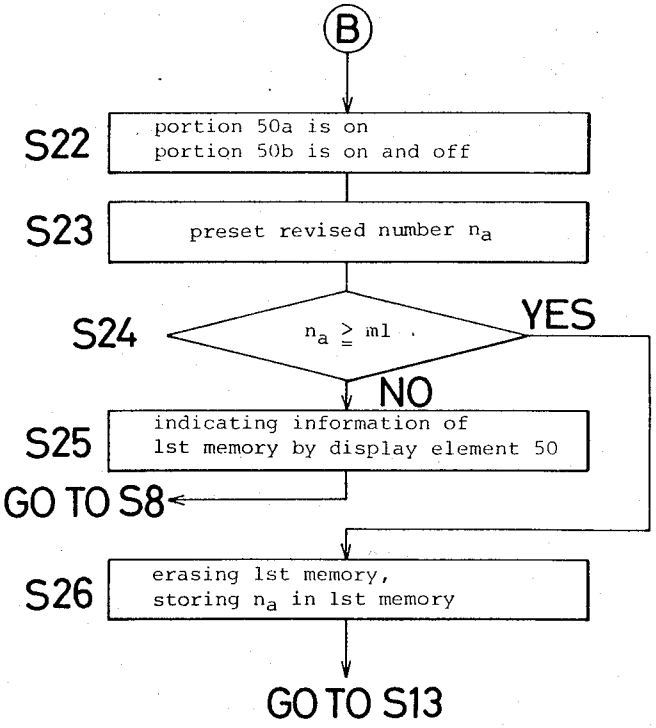
Figure 6A:
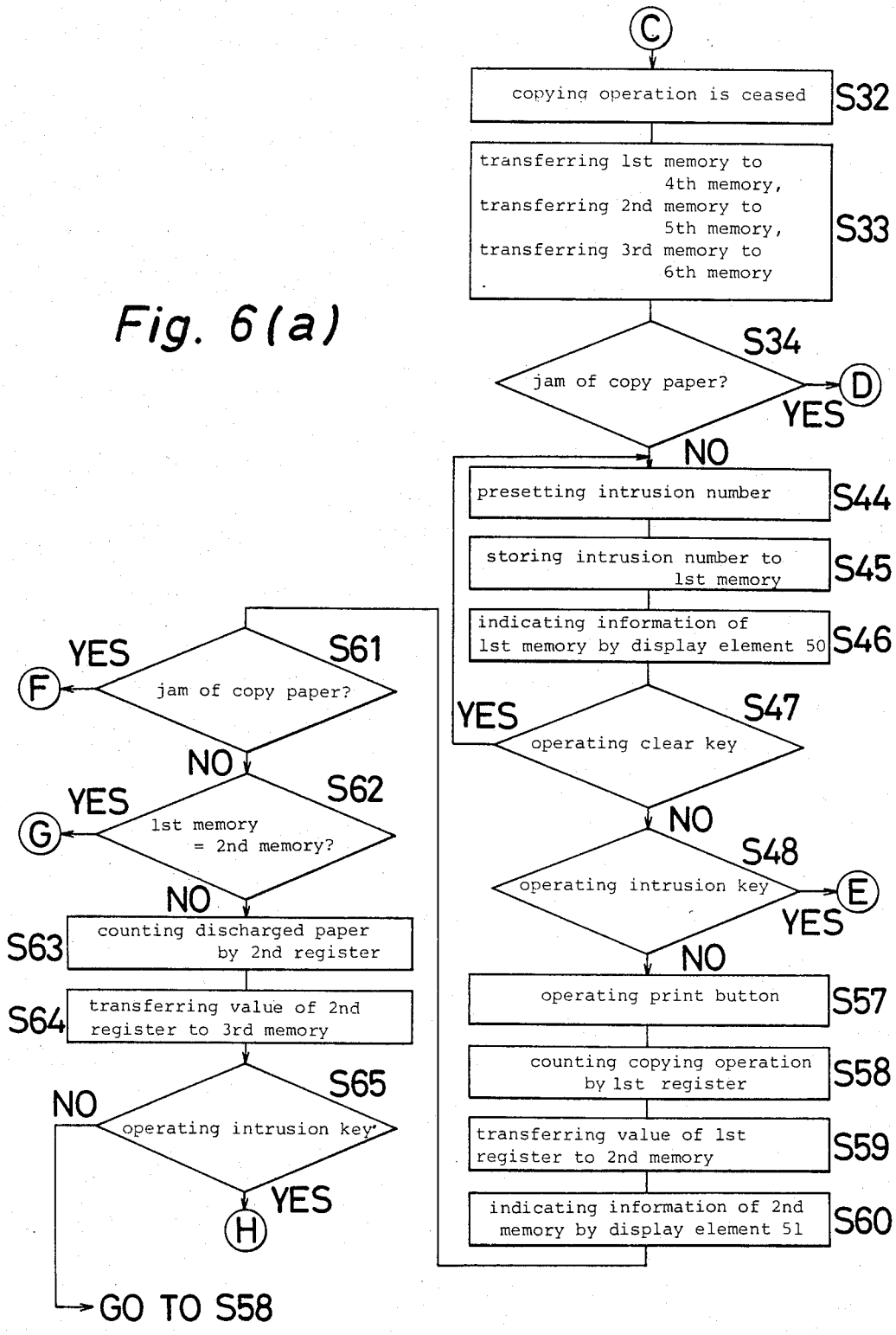
FIGS. 6 (*a*), (*b*), (*c*), (*d*), (*e*) and (*f*) are flow charts illustrating a operation of the control system in an intruded copying operation mode.
Figure 6B:
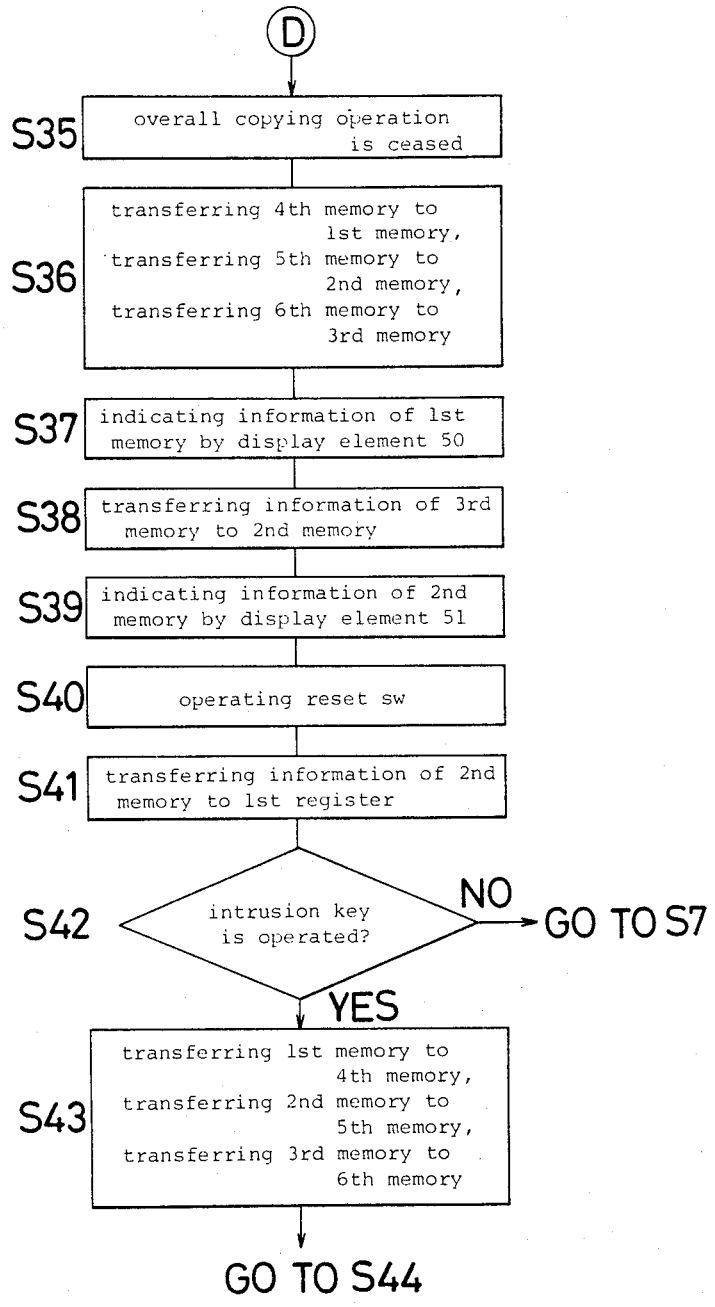
Figure 6C:
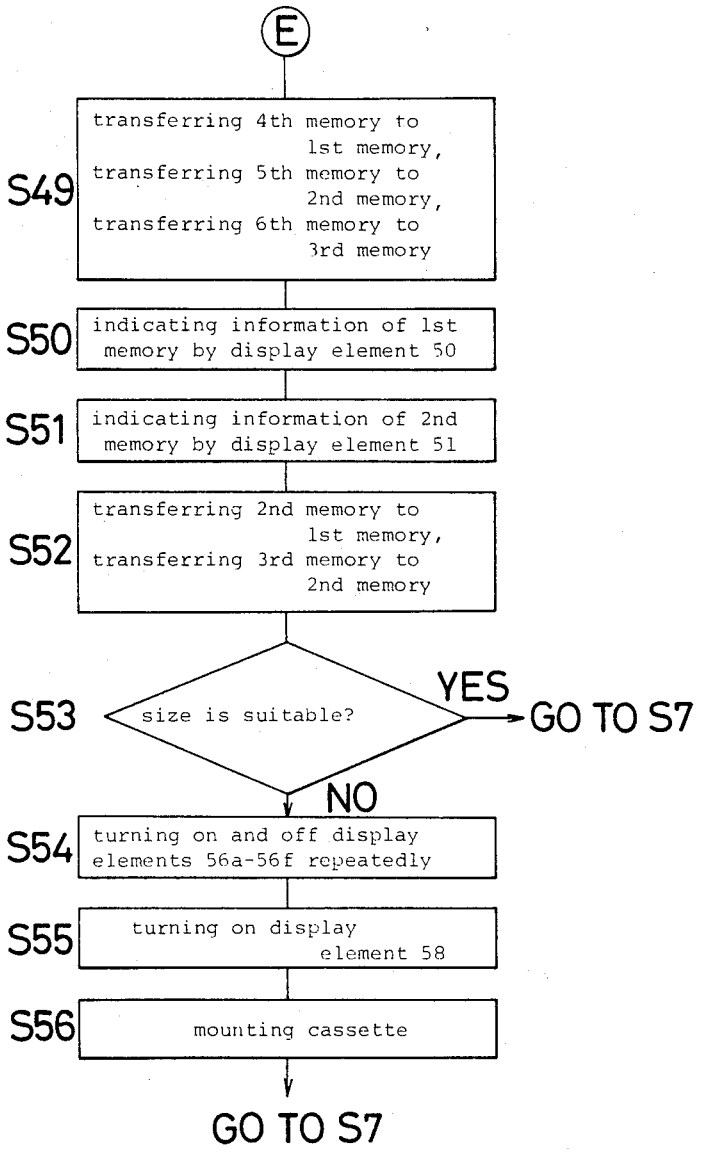
Figure 6D:
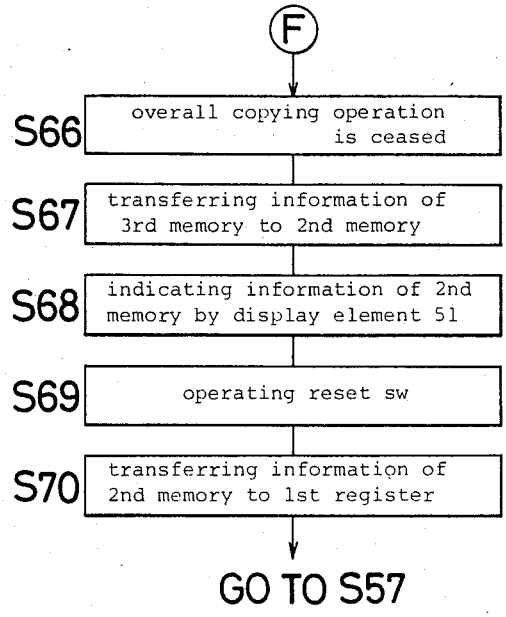
Figure 6E:
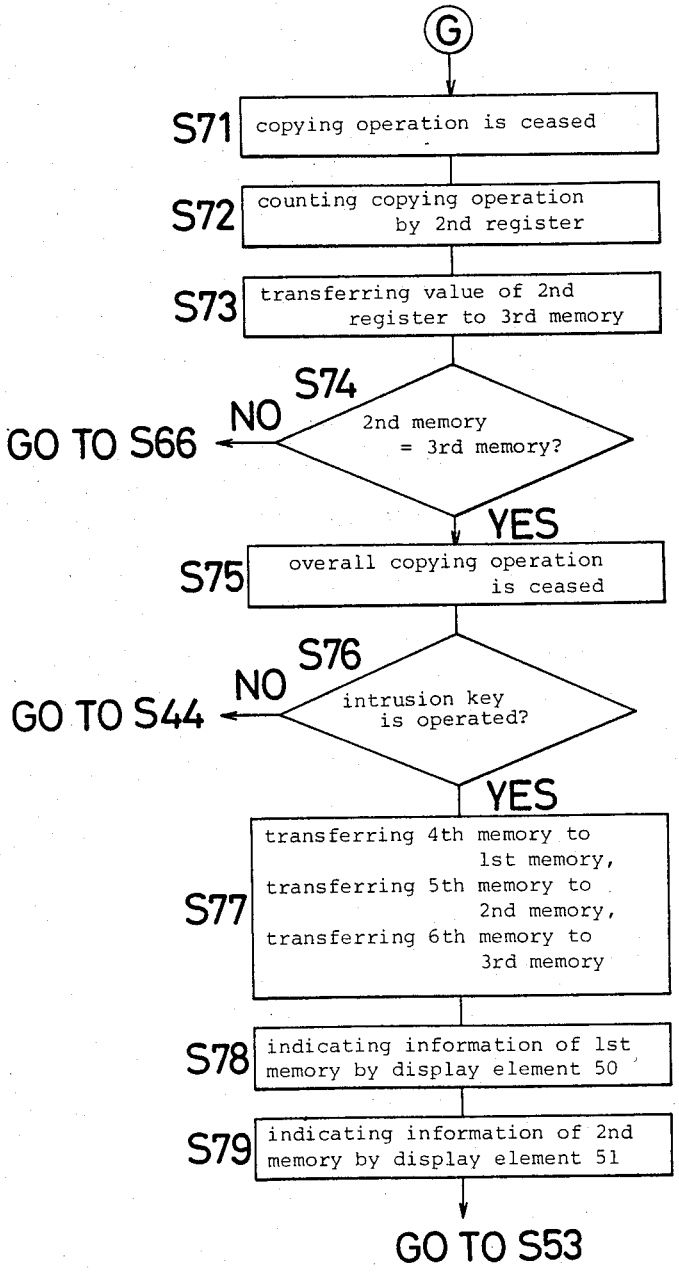
Figure 6F:
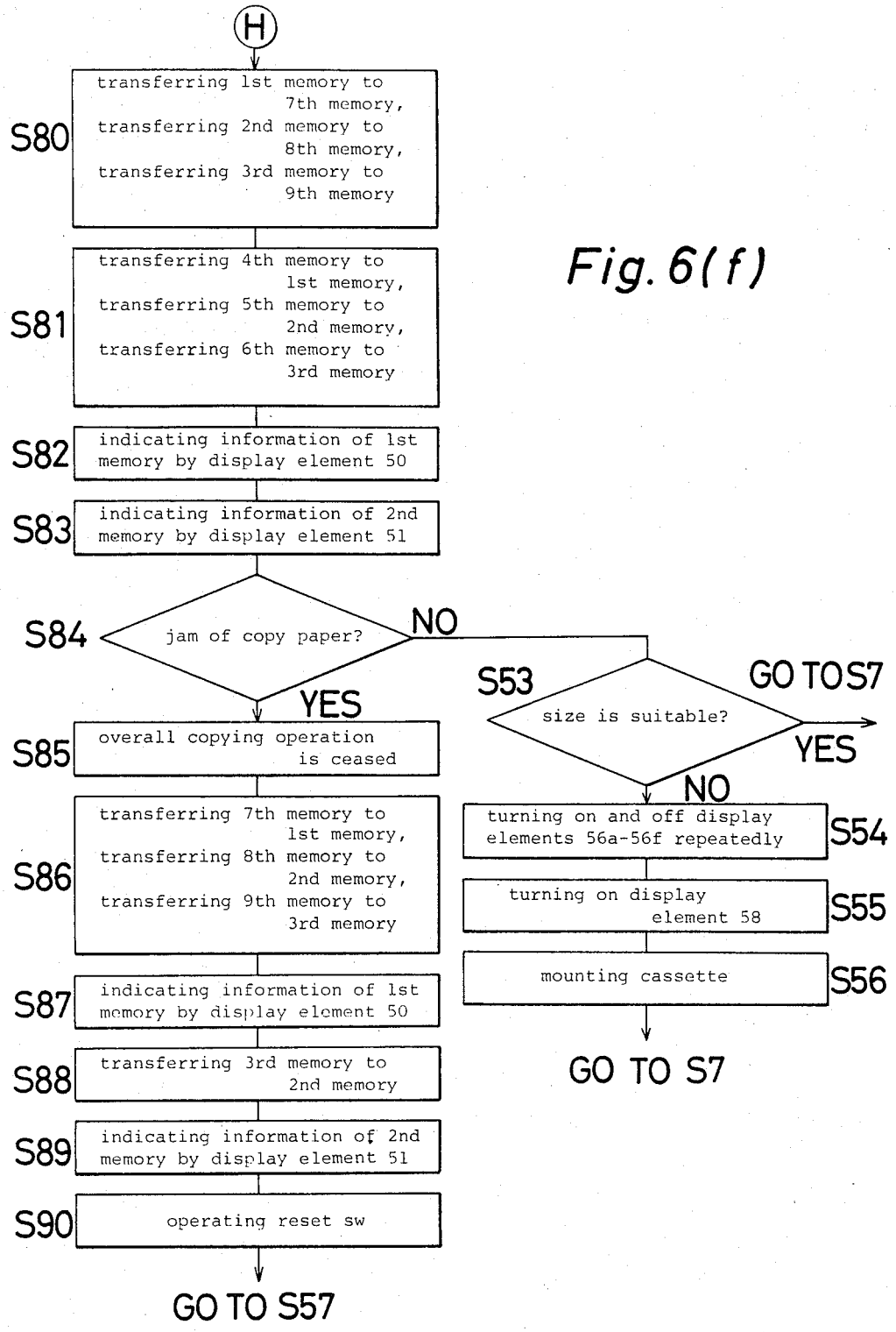

Referring now to FIGS. 5(*a*) to (*c*), there is shown a flow chart illustrating the operation of the control system shown in FIG. 4. Operation is performed in the order of the following steps in a successive copying operation mode wherein a predetermined plurality of copying operations corresponding to a single original document are performed successively.

(A) successive copying operation mode

The power switch 11 is manually operated in a step S1, and the control means 38 is set and enabled to operate. In the next step S2, the size detectors 32*a* to 32*c* supply signals to the control means 38 indicating which size of copy paper sheets is stored in the cassette 9 in accordance with the truth table 1.

TABLE 1

| Size | Size Detector | | |
|---|---|---|---|
| | 32a | 32b | 32c |
| A3 | 1 | 1 | 1 |
| B4 | 1 | 0 | 1 |
| A4 | 1 | 0 | 0 |
| B5 | 0 | 1 | 1 |
| A5 | 0 | 1 | 0 |
| B6 | 0 | 0 | 1 |
| No Cassette | 0 | 0 | 0 |

Referring to the table 1, in the case where the cassette 9 contains copy paper sheets having a JIS A3 size, each size detector 32*a* to 32*c* generates a high level signal which is supplied to the control means 38. Correspondingly, the control means 38 causes the driving means 59 to illuminate the size display element 56*a* in the step S2.

In a step S3, a signal indicating the predetermined number n1 of copying operations is preset by the ten key 12 and is supplied to the control means 38. The signal is stored in the first memory M1 of the control means 38 in a step S4. The control means 38 causes the driving means 59 to drive the preset number display element 50 in a step S5 for displaying the preset number n1 stored in the first memory M1 in the step S4.

Let us assume that the clear key 43 is manually operated in a step S6 so as to revise the preset number n1. The stored information in the first memory M1 is erased and the operation is performed again from the step S1. When the print button 13 is manually operated in a step S7, the control means 38 starts the copying operation of the electrostatic copying apparatus, so that the original document table 2 is moved reciprocally. The detecting switch 35 supplies a high level pulse signal to the control means 38 at each reciprocal movement of the original document table 2, that is, at the time when each copying operation corresponding to the original document 3 is performed. The control means 38 causes the first register R1 to count the high level pulse signal in a step S8, and causes the second memory M2 to store the counted value, namely the number m1 of copying operations, in a step 59. The control means 38 causes the driving means 59 to drive the copying number display element 51 for displaying the number m1 of copying operations stored in the second memory M2 in a step S10. In this fashion, the copying number display element 51 displays the number m1 of copying operations at each reciprocal movement of the original document table, that is, each time that a single copying operation of the electrostatic copying apparatus is performed.

In the next step S11, jam detecting circuit 33 detects whether or not a jam of the copy papers 8 has occured. In a case where a jam of the copy papers 8 does not occur, it is determined whether or not the revise key 60 has been manually operated to change the number of preset number n1 of copying operations in the next step S12. When the revise key 60 is not operated, the number n1 of copying operations stored in the first memory M1 and the number m1 of copying operations stored in the second memory M2 are compared with each other. In the case where the preset number n1 stored in the first memory M1 is not equal to the number m1 of copying operations stored in the second memory M2 ($n1 > m1$), the next step S14 is executed.

After the electrostatic copying apparatus performs a copying operation, the copy paper 8 is discharged on the tray 10. The detecting switch 36 supplies a high level pulse signal to the control means 38 each time that the copy paper 8 is discharged. The control means 38 causes the second register R2 to count the high level pulse signal in the step S14, and causes the third memory M3 to store the counted value, i.e. the number of discharged copy papers m2 in a step S15.

In a step S16, it is determined whether or not the intrusion key 42 has been manually operated. In the case where the intrusion key 42 is not operated, a new operation commences from the step S8.

When the jam of the copy paper 8 is detected in the step S11, the general copying operation of the electrostatic copying apparatus is stopped in a step S17 as shown in FIG. 5(*b*). The general copying operation of the electrostatic copying apparatus includes moving of the original document table 2, the photosensitive drum 22 and feeding roller 25 and other rollers to transfer the copy paper 8. In the next step S18, the number m2 of the discharged copy papers stored in the third memory M3 is transferred so as to be stored in the second memory M2. At the same time, the number m1 of copying operations which was prestored in the second memory M2 is erased. In a step S19, the number m2 of discharged copy paper stored in the second memory M2 is displayed by means of the copying operation display element 51 which is driven by the driving means 59.

When the jammed copy paper 8 is taken out from the housing 1 and the reset switch 39 is manually operated in a step S20, the electrostatic copying apparatus is released from discontinuation of the general copying operation in the step S17 and is able to perform copying operations. At the same time that the reset switch 39 is manually operated in the step 20, the number m2 of the discharged copy papers stored in the second memory M2 is transferred to as to be stored in the first register R1 is a step S21. A series of operations is performed again from the step S7 owing to the manual operation of the print button 13, and in the step S8, the first register R1 begins to operate for counting from discharged copy sheet number m2. Accordingly, the number of copying operations (n1-w2) which remained when a copy paper was jammed are performed so that the required copied paper sheets are obtained.

When the revise key 60 is manually operated in the step S12, the control means 38 causes the driving circuit 59 to disable the display element 50*a* in a step S22 shown in FIG. 5(*c*) and to enable the display element 50(*b*) intermittently. The operation of the control means 38 in the step S22 is maintained for a predetermined time period such as 3 seconds. In the operation of the step S22, the operations of the steps S8 to S16 are performed successively by the control means 38.

When the ten key 12 is operated to provide a signal indicating a revised number $n_a$ of copying operations to the control means 38 in a step S23, the control means 38 compares the revised number $n_a$ supplied from the ten key 12 with the number m1 of the copy papers which have been copied in a step S24. In the case where the revised number $n_a$ is greater than the preset number m1, the preset number n1 stored in the first memory M1 is erased, and the revised number $n_a$ is stored in the first memory M1 in a step S25. Instantaneously, the revised number $n_a$ stored in the first memory M1 is displayed by the preset number display element 50 as a new preset number of copying operations. Therefore, in the step S13, the revised number $n_a$ stored in the first memory M1 and the number m1 of the copying operations stored in the second memory M2 are compared. As a result, the copying operations of step S8 to S16 are performed repeatedly until the number m1 of copying operations becomes equal to the revised number $n_a$. In other words, copying operations of the electrostatic copying apparatus are performed repeatedly until the number m1 of copying operations displayed by the copy number display element 51 becomes equal to the revised number $n_a$ displayed by the preset number display element 50.

In the case where the revised number $n_a$ is less than the number m1, the number n1 is displayed by the preset number display element 50 in the steps S24 to S26. Then, the number n1 stored in the first memory M1 and the number m1 of copying operations stored in the second memory M2 are compared. As a result, copying operations are performed repeatedly from the steps S8 to S13 until the number m1 of copying operations becomes equal to the revised number $n_a$. In other words, copying operations of the electrostatic copying apparatus are performed until the number m1 of copying operations indicated by the copy number display element 51 is equal to the number n1 indicated by the preset number display element 50.

Consequently, when the preset number n1 is revised, it is not necessary to subtract the revised number $n_a$ i.e. the number of copying paper to be copied from the number m1 of copy papers which has been copied to input the resultant value ($n_a$-m1) by the operation of the ten key 12. According to the invention, the operator may input the revised number $n_a$ of the copy papers to be copied by the manual operation of the revise key 60. Therefore, the situation is avoided in which the operator presets a wrong number such that copy papers are consumed wastefully. Also, it is easy to operate the electrostatic copying apparatus.

When the information stored in the first memory M1 and the information stored in the second memory M2 are found equal to each other in the step S13, the copying operation of the electrostatic copying apparatus is stopped in a step S27. The copying operation of the electrostatic copying apparatus includes the movements of the original document table 2, the photosensitive drum 22 and paper feeding roller 25, etc. for transporting the copy paper 8, and does not include movements of the discharge rollers 28 and other rollers for discharging the copy papers 8 having been copied from the housing 1, and therefore is different from the general copying operation as discribed previously. In the next step S28, the second register R2 counts the number of copy papers 8 which have been discharged from the housing 1 after the copying operation of the electrostatic copying apparatus was stopped. In a step S29, the third memory M3 stores the counted value counted by the second register R2 in the step S28, that is, the number m2 of discharged copy papers 8. In a step S30, the number m1 of copying operations stored in the second memory M2 and the number m2 of discharged copy papers stored in the third memory M3 are compared. In the case where the number m1 of copying operations and the number m2 of discharged copy papers are equal to each other, the general copying operation of the electrostatic copying apparatus is terminated in the next step S31. In the case where the number m1 of copying operations stored in the second memory M2 and the number m2 of discharged copy papers 8 stored in the third memory M3 are different (m1>m2), the operation of steps S17 to S21 are performed as set forth previously. This means that the copy paper 8 which has been copied and is not discharged from the housing 1 is jammed when the copying operation is terminated in the step S27. In this fashion, the control means 38 controls the operation of (A) successive copying operation mode in the steps S1 to S31.

Briefly, in the case where a jam of the copy paper 8 occurs in (A) successive copying operation mode, the number m1 of copying operations counted by the first register R1 in accordance with each copying operation of the electrostatic copying apparatus is revised so as to be number m2 of discharged copy papers counted by the second register R2, and is stored in the second memory M2. Therefore, the number of jammed copy papers 8 is not added to the number m1 of copying operations even when a jam of the copy paper 8 occurs and the jammed copy paper is then taken out from the housing 1. Accordingly, the copied papers 8, the number of which was preset by the ten key 12, is obtained when the copying operation is commenced again after the release of the jam of the copy paper 8. Furthermore, it is not necessary to reset the preset number in case of a copy paper jamming.

It is determined in the step S16 whether or not the intrusion key 42 has been manually operated so as to achieve the intruded copying operation during the series of operations S1 to S31 set forth previously, namely, in the successive copying operation mode. Consequently, the interposed copying operation mode is performed according to the flow chart shown in FIGS. 6(*a*) to 6(*f*).

(B) Intruded copying operation mode

When the intrusion key 42 is manually operated, the copying operation of the electrostatic copying apparatus is stopped and the display element 46 is activated to indicate the state of the intruded copying operation mode as set forth previously in a step S32. In the next step S33, the information stored in the first, second and third memories M1, M2 and M3 are transferred so as to be stored in the fourth, fifth and sixth memories M4, M5 and M6 respectively. More specifically, the preset number n1 is stored in the fourth memory M4, the number m1 of copying operations is stored in the fifth memory M5, and the number m2 of discharged copy papers is stored in the sixth memory M6. A memory M7 stores the information that the cassette 9 used in the successive copying operation mode set forth previously is suitable for copy paper sheets having a JIS A3 size.

In a step S34, copy paper jamming is determined by the signal from the jam detecting circuit 33 when the intrusion key 42 is manually operated. When the jam of the copy paper 8 is detected, the display element 46 is inactivated and the general copying operation of the electrostatic copying apparatus stops in a step S35 as shown in FIG. 6(*b*). In the next step S36, the information stored in the fourth, fifth and sixth memories M4, M5 and M6 are transferred so as to be stored in the first, second and third memories M1, M2 and M3. More specifically, the preset number n1 is stored in the first memory M1, the number m1 of copying operations is stored in the second memory M2 and the number m2 of discharged copy papers is stored in the third memory M3. At this time, the preset number n1 stored in the first memory M1 is displayed by the preset number display element 50 which is driven by the driving means 59 in a step S37. In a step S38, the number m2 of discharged copy papers stored in the third memory M3 is transferred so as to be stored in the second memory M2. The number m2 of discharged copy papers stored in the second memory M2 is displayed by the copy number display element 51 which is driven by the driving means 59 in a step S39.

When the reset switch 39 is manually operated after the jammed copy paper 8 was taken out from the housing 1 in a step S40, the electrostatic copying apparatus is released from discontinuation which occured in the step S35, and is capable of performing a copying operation. In a step S41, the number m2 of discharged copy papers stored in the second memory m2 is transferred so as to be stored in the first register R1 at the same time that the reset switch 39 is manually operated in the step S40. In the case where the print button 13 is manually operated without the manual operation of the intrusion key 42 in a step S42, a series of operations from the step S7 set forth previously is repeated, and consequently the first register R1 commences a new counting operation from the number m2 of discharged copy papers in the step S8 to perform the copying operations equal to the number (n1-m2) which remained when the intrusion key 42 was manually operated in the step S16 and a jam had occured in the step S34.

In brief, in the steps S34 to S42, when the intrusion key 42 is manually operated and a jam of the copy paper 8 occurs, the intruded copying operation is not performed and state is returned to the state which is prior to the intruded copying operation, that is, the successive copying operation mode.

When the intrusion key 42 is manually operated again in the step S42, an operation equal to the step S33 set forth previously is performed and an intruded copying operation mode is capable of being carried out in a step S43. The following operation of the control means 38 is equal to that from a step S44 mentioned hereinafter.

The cassette 9 remains to be mounted on the housing 1 when the cassette 9 is suitable for the size of the original document to be copied intrusively, while another corresponding cassette is mounted on the housing 1 when the cassette is not suitable for the size of the original document to be copied intrusively. In other words, the cassette capable of keeping copy paper sheets having JIS B4 size is to be mounted when the original document to be copied has a JIS B4 size. Consequently, display element 56*b* is activated in response to the signal from the size detectors 32*a* to 32*c*.

The control means 38 commences to perform the step S44 to interpose a copying operation when copy paper jamming is not detected in the step S34. The control means 38 receives a signal indicating a preset number na1 for intrusion of a copying operation from the ten key 12 in the step S44, and the signal is stored in the first memory M1 in a step S45. At this time, stored information in the first register R1 and the second register R2 are erased. The control means 38 causes the driving means 59 to drive the preset number display element 50 in a step S46 to indicate the preset number $n_{a1}$ stored in the first memory M1 in the step S45. When, in the next step S47, the clear key 43 is manually operated to revise the preset number $n_{a1}$, the preset number $n_{a1}$ stored in the first memory M1 is erased and the operations are repeated from the step S44.

When the intrusion key 42 is manually operated again to release the intruded copying operation, the manual operation of the interposing key 42 is detected in a step S48. Accordingly, in a step S49 as shown in FIG. 6(*c*), the preset number n1 stored in the fourth memory M4 is transferred to the first memory M1, the number m1 stored in the fifth memory M5 is transferred to the second memory M2, and the discharged number m2 stored in the sixth memory M6 is transferred to the third memory M3. At this time, the preset number n1 stored in the first memory M1 is displayed by the preset number display element 50 in a step S50. Copy number m1 stored in the second memory M2 is displayed by the copy number display element 51 in a step S51. In a step S52, copy number m1 stored in the second memory M2 is transferred to the first register R1 and discharge number m2 stored in the third memory M3 is transferred to the second register R2.

In a step S53, it is determined whether or not the size of the copy paper which corresponds to the original document in the successive copying operation mode, and which is stored in the step S33 is equal to the size of the copy papers stored in the cassette which is mounted in the intruded copying operation mode. When these sizes are equal to each other, the remaining copying operations in the successive copying operation mode are performed from the step S7. When these sizes are not equal to each other, the display element such as 56*a* corresponding to the cassette to be mounted is turned on and off repeatedly in a step S54, and the display element 58 is turned on in a step S55. In this fashion, it is indicated that the cassette 9 storing copy papers whose size corresponds to the original document in the successive copying operation mode is to be mounted in the housing. Accordingly, when the cassette 9 is mounted in a step S56, the control means 38, in response to the size detectors 32*a* to 32*f*, causes the display element 58 to turn off and causes the size display element 56*a* to turn on. In this state, the print button 13 is manually operated again, the steps S7 to S16 and S27 to S31 mentioned previously are performed to complete the remaining number of copying operations.

In brief, in the case where the cassette 9 does not hold copy papers whose size corresponds to the original document in the successive copying operation mode after completion of the intruded copying operation mode, the display element 58 so indicates this state, and size display elements 56*a* to 56*f* are turned on and off repeatedly to indicate the size of copy papers to be used. Thus, copy papers having undesired sizes are not fed to the cassette 9.

Let us assume that the intrusion key 42 is not manually operated in the step S48; therefore, the intruded copying operation is not released and then the print button 13 is manually operated in a step S57. Steps S58 to S60 which are the same as the steps S8 to S10 in the successive copying operation mode are performed. More specifically, the first register R1 counts the number $m_{a1}$ of copying operations in the intruded copying operation mode. The counted value $m_{a1}$ stored in the first register R1 is transferred to the second memory M2. Stored information, that is, the number $m_{a1}$ of copying operations stored in the second memory M2, is displayed by means of the copy number display element 51.

In the next step S61, control means 38, in response to the output signal from the jam detecting circuit 33, determines whether or not the copy paper 8 is jammed in the intruded copying operation mode. When there is no occurrence of a copy paper jamming, the preset number $n_{a1}$ stored in the first memory M1 in the intruded copying operation and the number $m_{a1}$ of copying operations stored in the second memory M2 in the intruded copying operation are compared with each other in a step S62. When the preset number $n_{a1}$ and the number $m_{a1}$ of copying operation are not equal to each other ($n_{a1} > m_{a1}$), steps, S63 to S64, which are the same as the steps S14 to S15 mentioned previously, are performed. More specifically, the second register R2 counts the number $m_{a2}$ of the discharged copy papers in the intruded copying operation and the counted value that is equal to the number $m_{a2}$ of discharged copy papers is transferred so as to be stored in the third memory M3.

In a step S65, it is determined whether or not the intrusion key 42 has been manually operated so as to release the intruded copying operation. When the intrusion key 42 is not manually operated, operations are repeated from the step S58.

In the case where a jam of the copy paper is detected in the step S61, steps S66 to S70 as shown in FIG. 6(*d*) which are the same as the steps S17 to S21 mentioned previously are performed. More specifically, the electrostatic copying apparatus stops its overall copying operation, the number $m_{a2}$ of discharged copy papers stored in the third memory M3 is transferred so as to be stored in the second memory M2, and the copy number display element 51 driven by the driving means 59 displays the number $m_{a2}$ of discharged copy papers stored in the second memory M2. After the jammed copy paper is taken out from the housing 1 and then the reset switch 39 is manually operated, the cessation of the overall copying operation of the electrostatic copying apparatus is released, and the electrostatic copying apparatus is capable of performing the copying operation, and the number $m_{a2}$ of discharged copy papers stored in the second memory M2 is transferred to the first register R1. Then, the print button 13 is manually operated, operations are repeated from the step S57 mentioned previously so as to perform the number ($n_{a1}$-$m_{a2}$) of copying operation which remained at the occurrence of a jam in the intruded copying operation mode.

When the preset number $m_{a1}$ of intruded copying operations stored in the first memory M1 and the number $m_{a1}$ of copying operation stored in the second memory M2 in the copying operation are equal to each other, steps S71 to S75 which are the same as the step S27 to S31 mentioned previously are performed. More specifically, the second register R2 counts the number of copy papers which are discharged from the housing after the copying operation of the electrostatic copying apparatus is ceased, and the number $m_{a2}$ of discharged copy papers stored in the second register R2 is transferred to the third memory M3. The number $m_{a1}$ of copy papers stored in the second memory M2 and the number $m_{a2}$ of discharged copy papers stored in the third memory M3 are compared with each other. Consequently, when the number $m_{a1}$ of copying operations and the number $m_{a2}$ of discharged copy papers are equal to each other, the overall copying operation of the electrostatic copying apparatus is ceased. When the number $m_{al}$ of copying operations stored in the second memory M2 and the number $m_{a2}$ of the discharged copy papers stored in the third memory M3 are not equal to each other ($m_{a1} > m_{a2}$) in the step S74, it is determined that a copy sheet is jammed, and therefore the steps S66 to S70 mentioned previously are performed.

When the intrusion key 42 is manually operated in the next step S76 so as to release the intruded copying operation, stored information in the fourth to sixth memories M4 to M6 are transferred to the first to third memories M1 to M3 in a step S77. More specifically, the preset number n1 is stored in the first memory M1, the number m1 of copying operations is stored in the second memory M2, and the number m2 of discharged copy papers is stored in the third memory M3. The preset number display element 50 is driven by the driving means 59 so as to indicate the preset number n1 stored in the first memory M1 in a step S78. The copy number display element 51 is driven by the driving means 59 to display the number m1 of copying operations stored in the second memory M2 in a step S79.

After that, operation is returned to the step S53 to indicate whether copy papers whose size corresponds to the original document in the successive copying operation mode are stored in the cassette 9.

In the case where the intrusion key 42 is not manually operated in the step S76, namely, the intruded copying operation is not released, and then the number of copying operations in the intruded copying operation mode is set again by the ten key 12, operation is capable of being performed again from the step S44 mentioned previously.

When the intrusion key 42 is manually operated so as to release the intruded copying operation mode in the step S65 before the intruded preset copying number na1 stored in the first memory M1 and the intruded copying number ma2 stored in the second memory M2 are equal to each other, the situation is detected in the step S65 as mentioned previously. On operating the intrusion key 42, the display element 46 is turned off to indicate that the interposed copying operation mode is released as mentioned previously, and information stored in the first to third memories M1 to M3 are transferred to the seventh to ninth memories M7 to M9. More specifically, the seventh memory M7 stores the preset number $n_{a1}$, the eighth memory M8 stores the memory $m_{a1}$ of the copying operations, and the ninth memory M9 stores the number $m_{a2}$ of discharged copy papers in a step S80 shown in FIG. 6(*f*). In the next step S81, the information stored in the fourth to sixth memories M4 to M6 are transferred to the first to third memories M1 to M3. More specifically, the first memory M1 stores the preset number n1, the second memory M2 stores the number m1 of copying operations, and the third memory M3 stores the number m2 of discharged copy papers. In this state, the preset number n1 stored in the first memory M1 is displayed by the preset number display element 50 which is driven by the driving means 59 in a step S82. Copy number display element 51 is driven by the driving means 59 so as to display the number m1 of copying operations stored in the second memory M2 in a step S83.

When the intrusion key 42 is manually operated in the step S65 and when the copy paper 8 is jammed, the situation is detected in a step S84. On detecting the occurrence of a jam of the copy paper 8 in the step S84, the overall copying operation is ceased in a step S85, and information stored in the seventh to ninth memories M7 to M9 are transferred to the first to third memories M1 to M3. More specifically, the first memory M1 stores the preset number $n_{a1}$, the second memory m2 stores the number $m_{a1}$ of copying operations, and the third memory M3 stores the number $m_{a2}$ of discharged copy papers in a step S86. In this state, the preset number $n_{a1}$ stored in the first memory M1 is displayed by the preset number display element 50 which is driven by the driving means 59 in a step S87. In a step S88, the information stored in the third memory M3 is transferred to the second memory M2. In the next step S89, the copy number display element 51 is driven by the driving means 59 so as to display the number $m_{a1}$ of copying operations stored in the second memory M2 in the step S89.

The electrostatic copying apparatus is released from the state of discontinuation of the overall copying operation, and is capable of performing the copying operation in the step S85 after the jammed copy paper 8 is taken out from the housing 1 followed by a manual operation of the reset signal 39 in a step S90. Then, the control means 38 performs operation from the step S57 set forth previously. More specifically, changing from the intruded copying operation mode to the successive copying operation mode is prohibited when the intrusion key 42 is manually operated to release the intruded copying operation mode before the completion of the intruded copying operation and a jam of copy paper has occurred. Accordingly, operation starts from the step S58 as mentioned previously to perform the remaining copying operations ($n_{a1}$-$m_{a2}$) in the intruded copying operation mode after the print button 13 is operated.

In the case where the occurrence of a pin of the copy paper is not detected in the step S84, the control means 38 is capable of controlling the copier so as to perform the operations from the step S53 as set forth previously to obtain the number (n1-m2) of copied sheets which remained to be copied after the intruded copying operation.

In brief, when a jam of copy paper 8 has occurred in the intruded copying operation mode, the number $m_{a1}$ counted by the first register R1 according to a single copying operation of the electrostatic copying apparatus is revised so as to be equal to the number $m_{a2}$ of discharged copy papers counted by the second register R2, and then the revised number $m_{a2}$ is transferred to the second memory M2. Therefore, when a jam of copy paper 8 has occurred and then the jammed copy paper 8 is taken out from the housing 1, the number of jammed copy papers 8 is not added to the number $m_{a1}$ of copying operations. Accordingly, it is allowed to obtain the number $n_{a1}$ preset by the ten key 12 when copying operation is commenced again after release of jam of copy paper as is equal to the successive copying operation mode. More preferably, it is not necessary to revise the preset number $n_{a1}$ when a jam of copy paper has occurred. When manual operation is performed so as to change the successive operation mode to intruded copying operation mode so as to change the intruded copying operation mode to the successive copying operation mode to interrupt each former operation mode, and a jam of copy paper occurs, a change in the operation mode is prevented. The number m1 and $m_{a1}$ of copying operations counted by the first register R1 in the operation mode prior to the manual changing operation is revised so as to be equal to the number m2 and $m_{a1}$ of discharged copy papers counted by the second register R2 respectively to be transferred to the second memory M2. Accordingly, when manually changing the operation of an operation mode and a jam of copy paper occurs, it is capable of obtaining the number $n_{a1}$, $n_{a2}$ of copy papers preset by the ten key 12 in each operation mode, and it is not necessary to revise the preset number n1 and $n_{a1}$.

Figure 7:
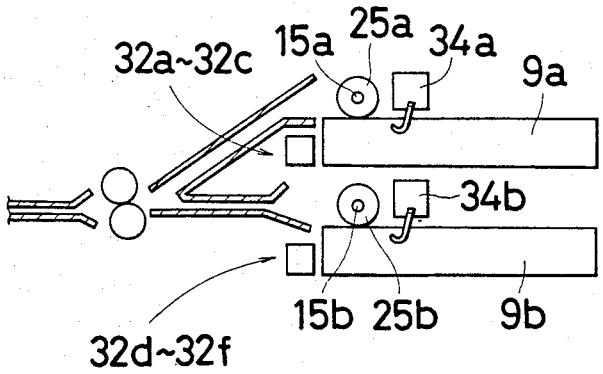
FIG. 7 is a simplified sectional view showing cassettes of the copying apparatus according to another aspect of the invention.

FIG. 7 is a simplified cross sectional view showing cassettes 9*a* and 9*b* of the electrostatic copying apparatus according to another aspect of the invention. In this embodiment, an upper cassette 9*a* and a lower cassette 9*b* are mounted on the electrostatic copying apparatus for keeping copy paper sheets of JIS size A3, B4, A4, B5, A5 or B6 respectively. Feeding rollers 25*a* and 25*b* are fixed rigidly to the rotary shafts 15*a* and 15*b* respectively and located so as to be in contact with the top sheet of copy papers stacked in the cassettes 9*a* and 9*b* respectively so that copy papers are fed out from either of cassettes 9*a* and 9*b* when either of feeding rollers 25*a* and 25*b* is driven so as to rotate.

Detecting switches 34*a* and 34*b* are provided above the cassettes 9*a* and 9*b* to detect copy papers stacked in the cassettes 9*a* and 9*b* respectively. Detectors 32*a* to 32*c* and 32*d* to 32*f* are provided in the vicinity of the cassettes 9*a* and 9*b* to detect the JIS size of the copy papers stored in the cassettes 9*a* and 9*b* respectively.

Control means 38 as shown in FIG. 4 receives detecting signals supplied from the detectors 32*a* to 32*c* and 32*d* to 32*f* and the detecting switches 34*a* and 34*b*.

Figure 8:
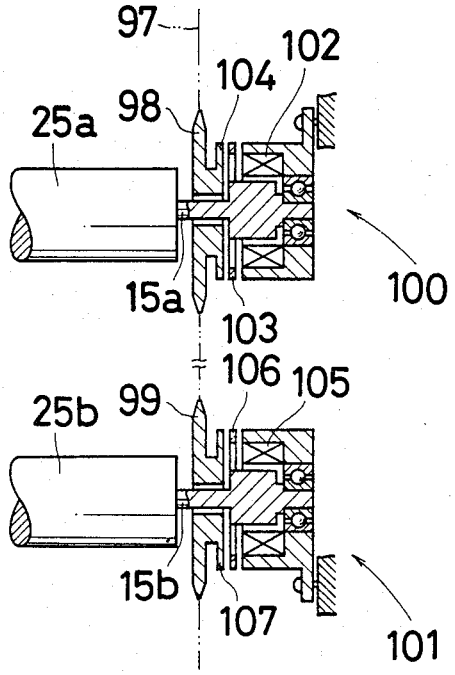
FIG. 8 is a sectional view showing a vicinity of the ends of the feeding rollers in FIG. 7.

FIG. 8 is a cross sectional view showing a vicinity of the ends of the feeding rollers 25*a* and 25*b*. There are provided magnetic clutches 100 and 101 having sprocket wheels 98 and 99 which are driven by a driving means (not shown) via chains 97 respectively. The magnetic clutches 100 and 101 are fixed to the housing 1 of the electrostatic copying apparatus. A coil 102 of the magnetic clutch 100 is energized so as to connect a rotary disc 103 and a clutch plate 104 by a magnetic force so that the rotary shaft 15*a* and the feeding roller 25*a* are driven to rotate in the same direction as the sprocket wheel 98 so as to feed copy paper sheets stacked in the cassette 9*a*. When the coil 102 is not energized, the rotary disc 103 and the clutch plate 104 are apart from each other. Therefore, the sprocket wheel 98 rotates about the rotary shaft 15*a* idlly. Similarly, a coil 105 of the magnetic clutch 101 is energized so as to connect a rotary disc 106 and a clutch plate 107 by a magnetic force so that the rotary shaft 15*b* and the feeding roller 25*b* are driven to rotate together with the sprocket wheel 99. When the coil 105 is not energized, the sprocket wheel 99 rotates about the rotary shaft 15*b* idlly.

The control means 38 (see FIG. 4) supplies control signals to energize the coils 102 and 105. The operation panel 40 as referred in FIG. 3 has a selecting switch (not shown) used to generate a selecting signal which is fed to the control means 38 in order to select the cassette 9*a* or 9*b* for feeding the copy papers. According to one aspect of this embodiment, it is convenient for users because the manual replacement of cassettes is not required when either of cassettes 9*a* and 9*b* keeps copy paper sheets to be intrusively copied.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. In a copying apparatus for performing a successive copying operation mode wherein a first preset number of copying operations corresponding to a first original document is performed successively according to a preset operation, and for performing an operation wherein after a second preset number of copying operations corresponding to a second original document is intruded to be copied on the way of the successive copying operation mode, the remaining number of copying operations of the first preset number corresponding to the first original document is performed, the improvement comprising;

a preset number display element for displaying the first and the second preset number of copying operations, a first counting means for counting copying operations at each time when a single of copying operation is performed, a copy number display element for indicating a number counted by the first counting means, a second counting means for counting a copy paper discharged after completion of copying operation, a detecting means for dectecting an occurrence of copy paper jamming, and a control means for revising the value counted by the first counting means to a value counted by the second counting means when a copy paper is jammed.

2. A copying apparatus according to claim 1, wherein there is provided a key for changing copying operation modes between the successive copying operation mode and the intruded copying operation mode, and said control means prohibits changing the operation mode and revising the counted value of the first counting means to the counted value of the second counting means in case the jam of copy paper occurs when the key is manually operated to change the copying operation mode.

3. A copying apparatus according to claim 1, wherein there is provided a revise key for revising the first and second preset numbers of copying operations, said control means operating in response to a signal from the revise key so as to cause the preset number display element to indicate the revised number of copying operations.

4. A copying apparatus according to claim 1, further comprising:

a size detector for detecting sizes of copying paper sheets kept in a cassette, and a display means for indicating that the size of the copy paper sheets kept in the cassette are different from a desired size, said display means being activated when the size of the copy paper sheets kept in the cassette does not correspond to the first original document after the operation mode of the copying apparatus has returned to the successive copying operation mode from the intruded copying operation mode.

5. A copying apparatus according to claim 1, wherein the preset number display element and the copy number display element are composed of 7B font respectively.

6. A copying apparatus according to claim 3, wherein:

the preset number display element comprises a first display portion having 7B font and a second display portion for indicating dots, and the control means receives a signal from the revise key and causes the first display portion to turn off and causes the second display portion to turn on and off repeatedly.

7. A copying apparatus according to claim 4, wherein there is further provided a display element for indicating that the size of the copy paper kept in the cassette is different from the size of the original document in the successive copying operation mode when the operation mode returns to the successive copying operation mode from the intruded copying operation mode.

8. A copying apparatus according to claim 4, wherein the display means includes a plurality of size display elements for indicating plural kinds of copy paper sheet sizes detected by the size detectors respectively, and wherein said control means causes the size display element corresponding to the size of the copy paper sheet kept in the cassette to turn on and off repeatedly and causes the size display element corresponding to the original document in the successive copying operation mode to turn on when the size of the copy paper kept in the cassette is not suitable for that of the original document in the successive copying operation mode after operation mode returns to the successive copying operation mode from the intruded copying operation mode.

9. A copying apparatus according to claim 2, wherein there is provided a revise key for revising the first and second preset numbers of copying operations, said control means operating in response to a signal from the revise key so as to cause the preset number display element to indicate the revised number of copying operations.

10. A copying apparatus according to claim 9, wherein:

the present number display element comprises a first display portion having 7B font and a second display portion for indicating dots, and the control means receives a signal from the revise key and causes the first display portion to turn off and causes the second display portion to turn on and off repeatedly.

11. A copying apparatus according to claim 2, further comprising:

a size detector for detecting sizes of copying paper sheets kept in a cassette, and a display means for indicating that the size of the copy paper sheets kept in the cassette are different from a desired size, said display means being activated when the size of the copy paper sheets kept in the cassette does not correspond to the first original document after the operation mode of the copying apparatus has returned to the successive copying operation mode from the intruded copying operation mode.

12. A copying apparatus according to claim 3, further comprising:

a size detector for detecting sizes of copying paper sheets kept in a cassette, and a display means for indicating that the size of the copy paper sheets kept in the cassette are different from a desired size, said display means being activated when the size of the copy paper sheets kept in the cassette does not correspond to the first original document after the operation mode of the copying apparatus has returned to the successive copying operation mode from the intruded copying operation mode.

13. A copying apparatus according to claim 1, further comprising:

first and second cassettes for respectively storing copy paper sheets of different sizes corresponding to said successive and intruded copying operation modes, and a changeover means which, when a mode change occurs during a copying operation in either of said two modes, automatically controls said apparatus such that copy paper sheets are selected from the one of said first and second cassettes having the correct size copy paper sheets.

14. A copying apparatus according to claim 2, further comprising:

first and second cassettes for respectively storing copy paper sheets of different sizes corresponding to said successive and intruded copying operation modes, and a changeover means which, when a mode change occurs during a copying operation in either of said two modes, automatically controls said apparatus such that copy paper sheets are selected from the one of said first and second cassettes having the correct size copy paper sheets.

15. A copying apparatus according to claim 3, further comprising:

first and second cassettes for respectively storing copy paper sheets of different sizes corresponding to said successive and intruded copying operation modes, and a changeover means which, when a mode change occurs during a copying operation in either of said two modes, automatically controls said apparatus such that copy paper sheets are selected from the one of said first and second cassettes having the correct size copy paper sheets.

16. A copying apparatus according to claim 9, further comprising:

first and second cassettes for respectively storing copy paper sheets of different sizes corresponding to said successive and intruded copying operation modes, and a changeover means which, when a mode change occurs during a copying operation in either of said two modes, automatically controls said apparatus such that copy paper sheets are selected from the one of said first and second cassettes having the correct size copy paper sheets.

* * * * *